United States Patent [19]

Eichweber

[11] 4,096,380

[45] Jun. 20, 1978

[54] SYSTEM FOR TRANSMITTING LIGHT SIGNALS BETWEEN A MISSILE AND A MISSILE CONTROL STATION

[76] Inventor: Kurt Eichweber, Holsteiner Chaussee 379/81, Hamburg-Schnelsen, Germany

[21] Appl. No.: 704,029

[22] Filed: Jul. 9, 1976

[30] Foreign Application Priority Data

Jul. 28, 1976 Germany ..... 2533697

[51] Int. Cl.[2] ..... H04B 9/00

[52] U.S. Cl. ..... 250/199; 244/3.14; 350/102; 358/109

[58] Field of Search ..... 250/199, 216, 578; 350/102, 103, 160, 160 LC, 161; 244/3.14; 340/27 NA; 358/209, 217, 229, 109; 356/4, 141, 172, 152

[56] References Cited

U.S. PATENT DOCUMENTS

| | | | |
|---|---|---|---|
| 3,137,794 | 6/1964 | Seward | 250/216 |
| 3,365,790 | 1/1968 | Brauer | 350/102 |
| 3,469,260 | 9/1969 | Holt | 244/3.14 |
| 3,493,294 | 2/1970 | Fitzmaurice | 350/200 |
| 3,620,626 | 11/1971 | Daly | 250/199 |
| 3,856,237 | 12/1974 | Torian | 244/3.14 |
| 3,954,340 | 5/1976 | Blomquist | 250/216 |
| 3,962,537 | 6/1976 | Kearns | 358/109 |
| 3,995,792 | 12/1976 | Otto | 244/3.14 |

*Primary Examiner*—Howard W. Britton

*Attorney, Agent, or Firm*—Prutzman, Hayes, Kalb & Chilton

[57] ABSTRACT

A system for transmitting light signals between a missile and a missile control launching site is provided by utilizing a laser beam light signal transmission path. The system comprises a laser emitter having a relatively broad transmission beam for producing a transmission path for the modulated light signals during the flight of the missile. The system obviates the need for light transmission lines or other physical connection between the missile and the control station and provides for continuously aiming the laser beam on the missile by means of a follow-up device responsive to a portion of the beam reflected from the missile. At least one crown of triple mirror reflectors is distributed about the axis of the missile to enable the missile to reflect the laser beam impinging thereon independently of the flight position of the missile. The laser beam is modulated to transmit control light signals from the control station and information light signals from the missile.

13 Claims, 2 Drawing Figures

12
52
51
49
MODULATOR
16
50
20
22'
24'
26'
22
24
26
54
10
14
15
47
46
18
12
LASER
EMITTER
13
34
38
32
12
39
36
28
30
28
64
12"
12'
14'

MODULA-
TION
UNIT
40
61
AUX.
COMPUTER
56
DEMOD-
ULATOR
44
CONTROL
UNIT
42
65
58
COMPU-
TER
62
CONTROL
COMPUTER
60

SYSTEM FOR TRANSMITTING LIGHT SIGNALS BETWEEN A MISSILE AND A MISSILE CONTROL STATION

BACKGROUND AND SUMMARY OF THE INVENTION

The present invention relates to a device for transmitting signals between a launching site and a missile by means of a light transmission path. More particularly, this device is intended for a weapon system in which missiles are guided from a launching site or base and in which a transmission path for modulated light, more specifically, a laser beam is produced between the base and the missile during the flight of the latter; modulation of the laser beam constituting control signals transmitted from the launching site to the missile and/or information signals transmitted in the opposite direction.

German Offenlegungsschrift DT No. 2,012,293 discloses a weapon system of this type wherein the transmission path consists of a flexible fiber light line designed to be uncoiled from the missile. The fiber light line is connected to a laser or laser diode, both at the launching base and the missile; control signals to the missile or information signals to the launching site, more specifically, from a camera provided on the missile, being transmitted through modulation of the laser or laser diode in time division multiplex. The advantage of transmitting signals by means of modulated light via a light line over signal transmission in which electrical signals are transmitted via a flexible copper line is primarily that of obtaining a broader band width.

The difficulties involved in producing reasonably priced fiber light lines which are capable of transmitting light over long distances with permissible loss ratios, are already known. Accordingly, the object of the present invention is to obviate this disadvantage and to produce a light transmission path in a weapon system of the above-described type without using a fiber light line and without any physical connection between the missile and the launching base.

According to the invention, this problem is solved by providing a transmission path in the form of a laser beam which is continuously aimed on the missile from the launching base by means of a follow-up device and which is reflected back to the base by the missile.

A transmission path of the type described can be produced over considerably longer distances and with a substantially reduced loss ratio as compared to transmission by means of light lines, while fully retaining the advantage of a broader band width. The information to be transferred from the missile to the base, for example, from a camera, can be effected in time division multiplex through modulation of the light reflected back from the missile. To this end, the missile is preferably equipped with at least one triple mirror reflector with an optical modulator connected in series therewith.

The follow-up device which continuously trains the laser beam on the missile preferably comprises a receiver for the reflected laser beam; this receiver being equipped with an angle discriminator so that the angular deflection of the reflected light beam portion from the median axis of the transmitted laser beam can be detected and used to determine the missile position or to control the laser emitter. This angle discriminator can consist of a prism whose top sides are inclined with respect to the base surface at an angle corresponding generally to the limiting angle of total reflection and which bear photoreceivers to which a differential connection is attached.

At least one crown of triple mirror reflectors comprising a modulator disposed in series therewith is preferably distributed about the axis of the missile to enable the missile to reflect the laser beam impinging thereon essentially independently of its instantaneous flight position. The triple mirror reflectors in the crown or crowns can also be inclined at different angles with respect to the axis so that they can reflect light striking parallel to the axis, at right angles to the axis and at intermediate angles thereto.

The laser emitter employed is preferably a powerful laser having a relatively broad transmission beam. $CO_2$ lasers are particularly suitable. In order to modulate the signals to be transmitted to the missile, a part of the emitted laser beam can be faded out by means of a beam divider and can be directed via an optical modulator.

Other objects will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figures 1, 2:
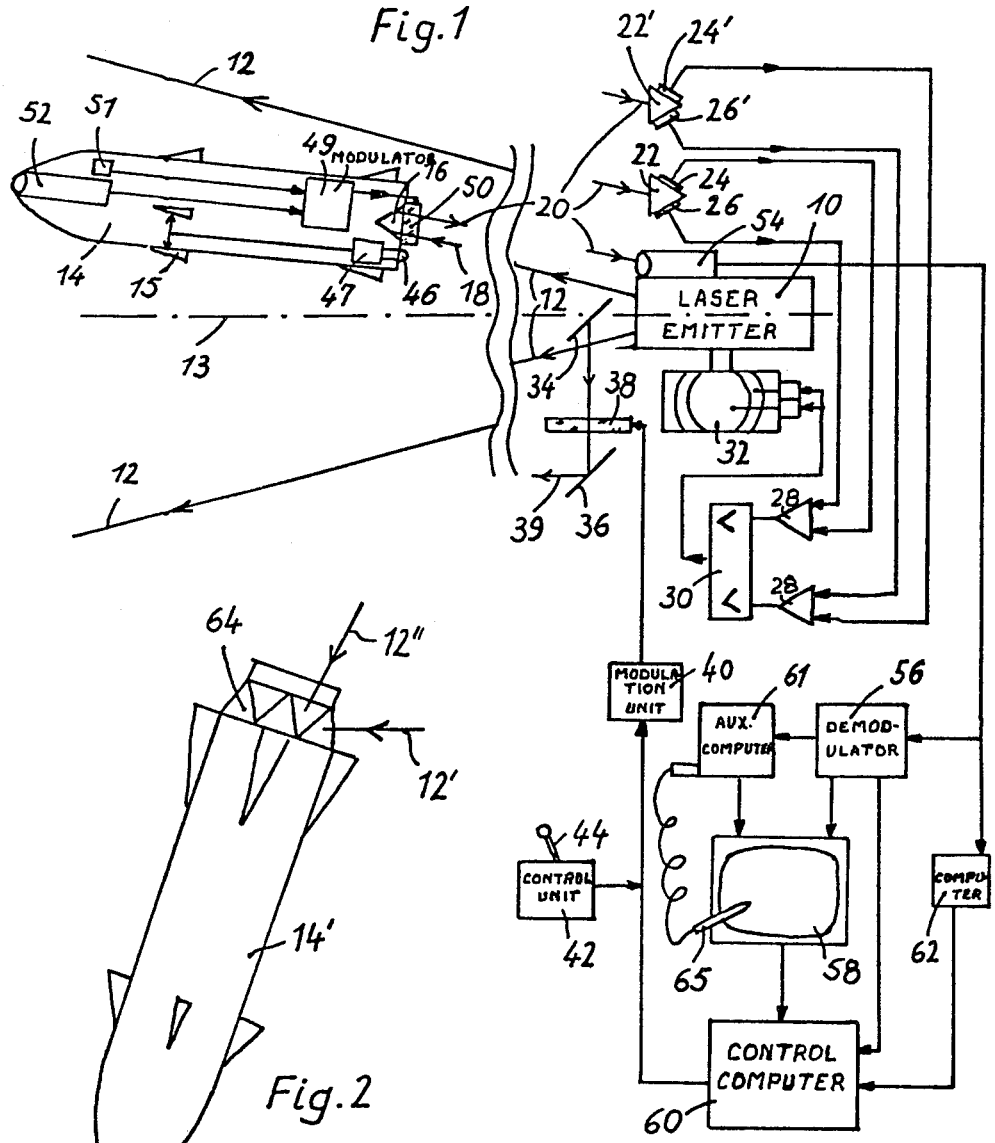
FIG. 1 is a diagrammatic view of the optical and signal processing devices at the launching site, fragmented to show the laser emitter and the missile flying within the laser beam.
FIG. 2 is another embodiment of the missile.

Referring now to the drawing, FIG. 1 shows a vertically and horizontally directable laser emitter 10 situated at a launching site or base. The laser emitter 10 emits a laser beam 12 with a relatively broad angular divergence, although in the drawing, this divergence has been exaggerated. The laser is preferably a $CO_2$ laser which can be operated by means of pulses (intermittently) or preferably by means of a continuous wave (continuously). There is no disadvantage in the laser emitter having a relatively broad transmission beam since, firstly, there is constant follow up on the beam axis and secondly, the beam is not directed at ground targets and consequently cannot easily be detected by the enemy.

A guidable missile 14 launched at the launching base by means of launching devices (not shown) is shown flying at some distance from the launching site within the already fairly broad laser beam 12. The missile carries a triple mirror reflector 16 in a suitable, aerodynamically advantageous disposition. A known property of a reflector of this type, which is generally in the form of a triangular prism comprising reflecting superfaces, is that within a limited generating angle zone; it reflects an impinging light beam parallel to itself irrespective of the angle of impingement. The reflector 16 thus reflects the portion 18 of the laser beam 12 impinging thereon, in the form of a beam 20 directed parallel to the impinging portion. If the missile 14 is not exactly on the axis 13 of the laser beam 12, the two beams 18 and 20 will be directed at a corresponding angle with respect to the axis 13.

The reflected beam 20 impinges on two angle discriminators 22, 22' at the launching base. These discriminators are in the form of prisms whose top sides are inclined with respect to the base surface at an angle close to the limiting angle of total reflection and which bear photodetectors 24, 26, 24', 26' respectively. Contrary to the drawing, the prisms are so arranged that their top edges are disposed at right angles to one another. For example, the top edge of the prism 22' may be situated parallel to the drawing plane. The axis of symmetry of each angle discriminator is disposed parallel to the axis 13 of the laser emitter 10. If the incoming base 20 is disposed, for example, in the vertical plane, at an angle with respect to this axis 13, and thus with respect to the angle bisectors of the top sides of the prism 22, it strikes the one top side at an angle which is smaller than the limiting angle of total reflection such that the beam is totally reflected on this top surface and the corresponding photodetector 24 receives no light. On the other hand, the angle of impingement of the light beam 20 on the other top surface of the prism is larger than the limiting angle of total reflection so that the light is not reflected on this top surface and it reaches the other photodetector 26 complete. Accordingly, with each angular deviation of the beam 20 from the axis 13, differing signals are received from the photodetectors 24, 26. Angular deviations in the horizontal plane are detected by the photodetectors 24', 26', in a similar manner. Control signals for a servo drive system 32 readjusting the aim of the laser emitter 10 on the missile in the vertical and horizontal directions, are obtained from the afore-mentioned signals by means of two differentiating members 28 and an amplifier 30. These control signals return to zero when the axis 13 is directed on the missile 14 and both photodetectors 24, 26 or 24', 26' receive an equal amount of light. Angle discriminators 22 of the above-described type are commercially available and permit angular resolution of a few seconds of arc. In place of two separate prisms, it is also possible to use a square prism which is capable of detecting deviations in both dimensions.

The laser beam which is continuously trained on the missile in this manner acts as a carrier for the transmission of information between the launching site and the missile. Signals can be transmitted from the launching site to the missile through modulation of the laser emitter 10. However, in the embodiment represented, the laser emitter per se is not modulated but a portion of the laser beam 12 is guided through an optical modulator 38 by means of partially permeable deflecting mirrors 34, 36 and is emitted parallel to the axis 13 in the form of the modulated beam 39. The light transmittance of the modulator 38 can be varied by means of electrical signals from a modulation unit 40. Modulators of this type consist, for example, of Kerr cells or Pockel cells, or more recently developed materials such as cadmium telluride, lithium iodate, lead lanthanum zirconium titanate, potassium tantalum niobate, inter alia. The choice will depend on the desired control rate and angular divergence. The signals which are transmitted are preferably guide signals for the missile. These guide signals can be produced at the launching site by means of devices which will be described hereinafter. The missile is equipped with a receiver 46 comprising a demodulator 47 which converts the received signals into guide commands for the guide fins 15 of the missile 14.

For signal transmission from the missile to the launching base, an optical modulator 50, controllable by means of a modulation unit 49, is connected in series with the triple mirror reflector 16. The modulator 50 superposes a modulation on the reflected beam 20. For example, this modulation can consist of information concerning the flight elevation of the missile or other measurement data from a sensor 51. A target detection device 52 is preferably mounted in a conventional manner in or on the missile. This target detector 52 consists, for example, of an infrared detector or preferably a camera such as a television camera, photodiode matrix camera, infrared camera, temperature entropy tester, etc., whose signals control the optical modulator 50. A receiver 54 on which the reflected beam 20 also impinges, guides the modulation signals to a demodulator 56 which passes them on, for example, to a projection screen unit 58 on which the picture information taken by the camera and showing the target zone at which the target is aimed, can be shown and observed. In addition, by means of the propagation time of the emitted and reflected laser beam, a distance measurement can be obtained using a distance computer 62, preferably by means of a special pulse code from the emitted laser beam.

Transmission of the signals from the launching base to the missile and vice-versa is preferably effected in time division multiplex according to conventional methods, possibly in addition to pulse coding for distance measurements.

Instead of only a single triple mirror reflector 16 and modulator 50, as represented in the drawing, the missile 14 is preferably equipped with a crown of reflectors and modulators. As shown in FIG. 2, this crown disposition can also be such that the reflectors are also capable of reflecting light impinging at broader angles with respect to the missile axis. More particularly, the reflectors in the crown 64 of reflectors surrounding the axis of the missile 14' can be arranged at different angles with respect to the missile axis such that both light 12' impinging transversely with respect to the axis and also light 12'' impinging virtually parallel to the axis, always finds a reflector. A plurality of crowns comprising differently directed reflectors can also be provided. As a result, it is also possible to obtain singal exchange between the missile and the launching base during the launching stage of an indirect shot when the missile is markedly inclined with respect to the axis of the laser beam. On the other hand, a single triple mirror is sufficient if the missile is equipped with a stabilizing device which controls its position in terms of the vertical and horizontal axes and/or if signal exchange only takes place on a horizontal flight path or in the ascending portion of an indirect ballistic flight path.

A manual control unit 42 comprising a guide stick 44 can be provided at the launching site to produce signals. The control signals can be produced, for example, by observing the target zone at which the missile is directed, and which appears on the screen 58. These control signals are supplied to the modulation unit 40. Control is preferably effected largely automatically by means of a computer 60 which calculates the control signals from given information and/or from the information transferred from the missile and supplies them to the modulation unit 40. The distance computer 62 is connected to the computer 60 which can also be supplied with information in the form of the instantaneous position coordinates of the continuously trained laser emitter 10. In the embodiment illustrated, the screen 58 is in the form of an active screen on which selected target points can be detected by means of an optical sensor or manipulator 65 such that their coordinates can be retrieved and supplied to the computer 60. An auxiliary computer 61 ensures that the coordinates represented on the target picture shown on screen 58 are correct. This process is also applicable when a camera is not used for taking pictures but when only a thermal ray detector is used to determine the correct coordinate distribution of the heat radiation from individual targets and to select the target and steer the missile towards it.

It is known to guide missiles towards a target by means of a laser guide beam directed on the target. The major disadvantage of such a system is that bearings can be taken on the launching base from the target, the distance can be measured and the base can be attacked and in that direct visibility between the launching site and the target is necessary. In contrast, the system according to the invention offers the advantage that it also permits indirect bombardment of targets which are not directly visible and which are located at long distances. It is possible to bring the missile into a position on an indirect ballistic flight path above a probable target zone, to transmit video information of the target zone to the launching base during the descent flight of the missile, to select a target by means of the transmitted picture and to guide the missile into the proximity of a selected target during the descent flight. The missile need only be brought sufficiently close to the selected target for a target finding and automatic guidance system, with which the missile is advantageously equipped, to properly determine the target and then to automatically guide the missile to the target in the last flight stage when it can no longer be detected by the laser beam.

The device according to the invention can also be used with unguided ballistic missiles for transmitting video signals from the missile to the launching site. These signals are then used to aim the launching devices for succeeding launchings. Laser light, both in the visible wave length range and also in the IR and UV range can be used as the laser beam according to the invention. The launching base comprising the laser emitter need not be stationary on the ground but can also be mounted on an airplane or ship or, for example, on a helicopter being used to shoot at ground targets, preferably indirectly.

As will be apparent to persons skilled in the art, various modifications, adaptations and variations of the foregoing specific disclosure can be made without departing from the teachings of the present invention.

I claim:

1. A system for transmitting control and/or information signals between a missile and a missile control station without physical connection therebetween comprising means at said control station for producing a transmission path for modulated light signals between said station and said missile during the flight of the missile, said transmission path consisting of an emitted laser beam, means for continuously aiming said laser beam on said missile from the control station, reflector means carried by said missile for reflecting part of said beam back to said control station said reflector means including at least one triple mirror reflector for reflecting the laser beam, said missile being equipped with a signal producing device and an optical modulator connected with the triple mirror reflector, the optical modulator being controllable by said signal producing device for modulation of at least one of said emitted and reflected laser beams to provide said signals, said missile being provided with a target detection device, said signal producing device being controlled by said target detecting device.

2. The system of claim 1 wherein the control station is equipped with distance measuring means for continuously determining the distance to the missile by measuring the time of travel of the emitted and reflected laser beam.

3. The system of claim 1 wherein the means of producing the transmission path includes a laser emitter and said continuous aiming means comprises a laser beam receiver comprising at least one angle discriminator for determining the angular deviation of the reflector beam from the axis of the emitted beam.

4. The system of claim 3 wherein the angle discriminator consists of a prism having at least one side inclined with respect to the front face thereof by an angle close to the limiting angle of total reflection of the laser beam, said side carrying a photoreceiver thereon.

5. The system of claim 3 wherein said aiming means includes servo drive means controlled by a differentiating circuit associated with said angle discriminator for controlling follow-up movement of said laser emitter.

6. The system of claim 1 wherein the reflector means includes a crown of triple mirror reflectors mounted about the axis of the missile.

7. The system of claim 6 wherein the triple mirror reflectors in said crown are so oriented that they are capable of reflecting light arriving parallel to the axis of the missile, transversely of the axis and at intermediate angles thereof.

8. The system of claim 1 wherein the means for producing the transmission path includes a broad transmission beam laser.

9. The system of claim 8 wherein the laser is of the $CO_2$ type.

10. The system of claim 1 wherein the control station is equipped with means for producing guide signals for the missile.

11. The system of claim 10 wherein the control station includes distance measuring means and a visual display means for visually displaying a target zone signal transmitted from the missile and said guide signal producing means comprises a computer connected to said distance measuring means and said visual display.

12. The system of claim 11 wherein said visual display means includes an active projection screen and an optical sensor.

13. A system for transmitting control and/or information signals between a missile and a missile control station without physical connection therebetween comprising means at said control station for producing a transmission path for modulated light signals between said station and said missile during the flight of the missile, said transmission path consisting of an emitted laser beam and said means including a laser emitter having modulation means for superimposing a modulation on the laser beam representing the control light signal for the missile, said emitter including a beam divider for separating a portion of the emitter laser beam and said modulation means including an optical modulator through which the separated beam portion is passed, means for continuously aiming said laser beam on said missile from the control station, reflector means carried by said missile for reflecting part of said beam back to said control station and means for modulation of at least one of said emitted and reflected laser beams to provide said signals.

* * * * *